US005168700A

United States Patent [19]

Furuya

[11] Patent Number: 5,168,700

[45] Date of Patent: Dec. 8, 1992

[54] METHOD OF AND AN APPARATUS FOR CONTROLLING THE AIR-FUEL RATIO OF AN INTERNAL COMBUSTION ENGINE

[75] Inventor: Junichi Furuya, Isesaki, Japan

[73] Assignee: Japan Electronic Control Systems Co., Ltd., Isesaki, Japan

[21] Appl. No.: 778,087

[22] PCT Filed: May 1, 1991

[86] PCT No.: PCT/JP91/00598

§ 371 Date: Dec. 12, 1991

§ 102(e) Date: Dec. 12, 1991

[30] Foreign Application Priority Data

May 1, 1990 [JP] Japan ..... 2-111768

[51] Int. Cl.[5] ..... F01N 2/20

[52] U.S. Cl. ..... 60/274; 60/276; 60/285; 123/688

[58] Field of Search ..... 60/274, 276, 285; 123/688

[56] References Cited

U.S. PATENT DOCUMENTS 4,251,990 2/1981 Norimatsu et al. ..... 60/276
5,117,631 6/1992 Moser ..... 60/276

FOREIGN PATENT DOCUMENTS 55-35181 3/1980 Japan .
61-237852 10/1986 Japan .
1-134749 5/1989 Japan .

*Primary Examiner*—Douglas Hart
*Attorney, Agent, or Firm*—Foley & Lardner

[57] ABSTRACT

First and second air-fuel ratio sensors are disposed upstream and downstream of a catalytic converter respectively, and these sensors provide detection signals used to set first and second air-fuel ratio correction quantities, respectively, whereby an averaged air-fuel ratio corection quantity is calculated. During a steady operation in which a change in the averaged air-fuel correction quantity is below a predetermined value, a final air-fuel ratio correction quantity is calculated according to the first and second air-fuel ratio correction quantities. During a transient operation in which a change in the averaged first air-fuel ratio correction quantity exceeds the predetermined value, the second air-fuel ratio correction quantity is fixed from when the change exceeds the predetermined value until a predetermined time has elapsed after the change drops below the predetermined value. This prevents a deviation of the air-fuel ratio due to the second air-fuel ratio correction quantity during the transient operation, and maintains a good air-fuel ratio not only during the steady operation but also during the transient operation.

10 Claims, 6 Drawing Sheets

Fig. 4 (1)
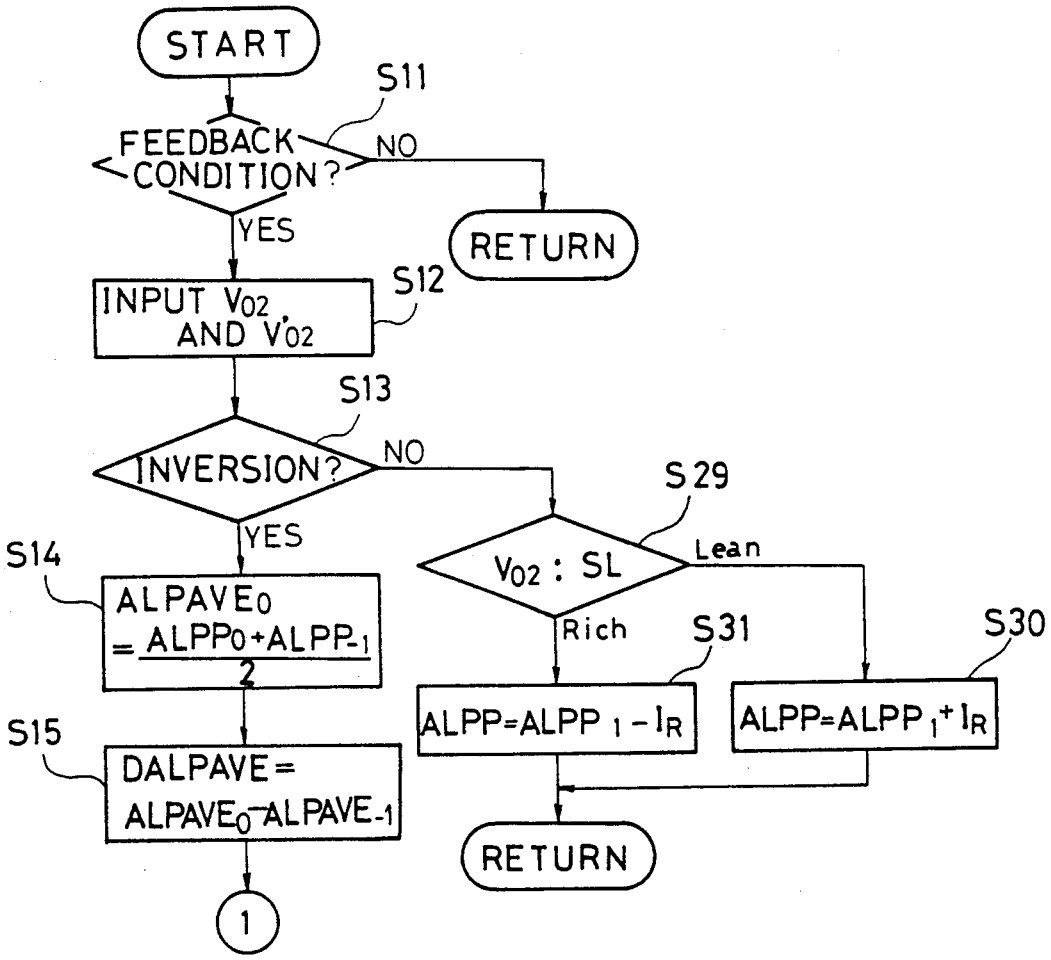

METHOD OF AND AN APPARATUS FOR CONTROLLING THE AIR-FUEL RATIO OF AN INTERNAL COMBUSTION ENGINE

TECHNICAL FIELD

The present invention relates to an apparatus for controlling the air-fuel ratio of an internal combustion engine, and particularly to a method of and an apparatus for precisely carrying out an air-fuel ratio feedback control according to values detected by two air-fuel ratio sensors disposed upstream and downstream of an exhaust purifying catalytic converter, respectively.

BACKGROUND ART

A conventional apparatus for controlling the air-fuel ratio of an internal combustion engine is disclosed in, for example, Japanese Unexamined Patent Publication No. 1-134749.

This disclosure will be roughly explained. An intake air quantity Q to the engine and an engine rotational speed N are detected to calculate a basic fuel supply quantity Tp (=K.Q/N, with K as a constant) for an intake air quantity supplied to a cylinder, the basic fuel supply quantity Tp is corrected according to an engine temperature, etc., and a feedback correction is carried out with an air-fuel ratio feedback correction coefficient (an air-fuel ratio correction quantity). This coefficient is based on a signal provided by an air-fuel ratio sensor (an oxygen sensor) for detecting the air-fuel ratio of an air-fuel mixture according to an oxygen concentration is an exhaust. The corrected quantity is further corrected according to a battery voltage, etc., to finally set a fuel supply quantity Ti.

A driving pulse signal having a pulse width corresponding to the fuel supply quantity Ti is provided to a fuel injection valve at a predetermined timing, to inject a predetermined quantity of fuel to the engine.

The air-fuel ratio feedback correction carried out according to the signal from the air-fuel ratio sensor is used to obtain a target air-fuel ratio (a theoretical air-fuel ratio). This feedback correction is carried out in an exhaust system because the converting efficiency (purifying efficiency) of an exhaust purifying catalytic converter (a three-way catalytic converter) for purifying an exhaust by oxidizing CO and HC (hydrocarbon) and reducing NOx contained in the exhaust is set to effectively function with a combustion based on the theoretical air-fuel ratio.

An electromotive force (an output voltage) of the air-fuel ratio sensor suddenly changes around the theoretical air-fuel ratio, and thus the output voltage V0 of the air-fuel ratio sensor is compared with a reference voltage (a slice level) SL corresponding to the theoretical air-fuel ratio, to determine whether the present air-fuel ratio is rich or lean with respect to the theoretical air-fuel ratio. If the air-fuel ratio is lean (rich), an air-fuel ratio feedback correction coefficient ALPP by which the basic fuel supply quantity Tp is multiplied is increased (decreased) by a large proportional portion P at the first time of a change to the lean (rich) side, and thereafter, is gradually increased (decreased) by a predetermined integral portion I. Accordingly, the fuel supply quantity Ti is increased (decreased) to obtain the target air-fuel ratio (the theoretical air-fuel ratio). The proportional portion may be omitted, and the air-fuel ratio feedback correction coefficient ALPP may be integrally set.

In this conventional air-fuel ratio feedback control apparatus, one air-fuel ratio sensor is arranged at a collecting portion of an exhaust manifold adjacent to a combustion chamber, to improve the responsiveness of the sensor. Since the temperature of an exhaust at this location is high, the properties of the air-fuel ratio sensor are deteriorated by heat. Also at this location, exhausts from respective cylinders are not sufficiently mixed, and thus it is difficult to detect a mean air-fuel ratio of all cylinders. This may lower the accuracy of detecting and controlling the air-fuel ratio.

To solve these problems, it has been proposed to arrange another air-fuel ratio sensor downstream of the exhaust purifying catalytic converter and carry out an air-fuel ratio feedback control according to the two air-fuel ratio sensors (Japanese Unexamined Patent Publication No. 61-237852).

Although the downstream air-fuel ratio sensor is not advantageous in terms of responsiveness, due to its distance from the combustion chamber, it is less affected by an imbalance of exhaust components (CO, HC, NOx, $CO_2$, etc.,) on the downstream side of the exhaust purifying catalytic converter, and therefore, its characteristics are less affected by toxic components contained in an exhaust. Accordingly, the downstream air-fuel ratio sensor can detect a mean air-fuel ratio of all cylinders and provide more accurate and stabilized data than the upstream air-fuel ratio sensor.

Data provided by the two air-fuel ratio sensors are processed as mentioned above to provide two air-fuel ratio feedback correction coefficients. The two coefficients may be combined to accurately carry out the air-fuel ratio feedback control. Alternatively, the downstream air-fuel ratio sensor may be used to correct a control constant (a proportional portion or an integral portion) applied to the air-fuel ratio feedback correction coefficient set by the upstream air-fuel ratio sensor, or to correct a comparison voltage or a delay time related to the output voltage of the upstream air-fuel ratio sensor, to thereby compensate a fluctuation in the output voltage of the upstream air-fuel ratio sensor and accurately carry out the air-fuel ratio feedback control.

During a transient operation (an acceleration or deceleration operation), however, a response delay in the air-fuel ratio feedback control by the upstream air-fuel ratio sensor causes a large fluctuation in an air-fuel ratio. If the air-fuel ratio feedback control by the downstream air-fuel ratio sensor is carried out during this period, the air-fuel ratio will be over-corrected. During an acceleration, for example, the air-fuel ratio feedback control by the downstream air-fuel ratio sensor over-corrects the air-fuel ratio toward a rich side. As a result, after the acceleration, it takes a long time to restore the target air-fuel ratio, and in the worst case, the air-fuel ratio is widely diverged to thereby cause a deterioration of the fuel consumption, exhaust quality, and output of the engine.

Therefore, to avoid this, the transient operation is detected by determining whether or not a throttle valve is completely closed, or whether or not a rate of change of any one of a throttle valve opening, intake air quantity, intake air pressure, engine speed, and vehicle speed is greater than a predetermined value. If it is determined to be a transient operation, the air-fuel ratio feedback control based on the downstream air-fuel ratio sensor is stopped, to prevent an over-correction.

This transient operation determining technique for stopping the air-fuel ratio feedback control by the downstream air-fuel ratio sensor is effective if the degree of transience is large, but this technique demonstrates a poor accuracy and long delay time when the degree of transience is so low that it is barely sufficient to invert the air-fuel ratio feedback correction coefficient. In this case, this technique cannot prevent an over-correction of the air-fuel ratio.

To solve the problems of the prior arts, an object of the invention is to start and stop the air-fuel ratio feedback control of the downstream air-fuel ratio sensor by monitoring the output of the upstream air-fuel ratio sensor, and prevent an over-correction of air-fuel ratio during a transient operation.

Another object of the invention is to properly control an air-fuel ratio not only during a steady operation but also during a transient operation.

Still another object of the invention is to properly control an air-fuel ratio and reduce polluting exhausts such as CO, HC, and NOx.

Still another object of the invention is to properly control an air-fuel ratio and maintain good transient operation characteristics.

DISCLOSURE OF THE INVENTION

To achieve these objects, a method of or an apparatus for controlling the air-fuel ratio of an internal combustion engine according to the invention includes:

first and second air-fuel ratio sensors disposed upstream and downstream, respectively, of an exhaust purifying catalytic converter in an exhaust path of the internal combustion engine, outputs of the sensors changing in response to the concentration of a specific gas component contained in an exhaust, this concentration being changed in response to the air-fuel ratio;

a first air-fuel ratio correction quantity calculation step or means for calculating a first air-fuel ratio correction quantity according to the output of the first air-fuel ratio sensor;

a second air-fuel ratio correction quantity calculation step or means for calculating a second air-fuel ratio correction quantity according to the output of the second air-fuel ratio sensor;

an air-fuel ratio correction quantity calculation step or means for calculating a final air-fuel ratio correction quantity according to the first and second air-fuel ratio correction quantities; and an air-fuel ratio feedback control step or means for carrying out a feedback control to obtain a target air-fuel ratio according to the final air-fuel ratio correction quantity, and comprises:

an averaging step or means for averaging first air-fuel ratio correction quantities derived from the first air-fuel ratio sensor; and a second air-fuel ratio correction quantity fixing step or means for fixing, if a change in the averaged first air-fuel ratio correction quantity exceeds a predetermined value, the second air-fuel ratio correction quantity, which is used by the air-fuel ratio correction quantity calculation means for calculating the air-fuel ratio correction quantity, to a predetermined value for a period of from the start of the excessive change until a predetermined time has elapsed after the change in the averaged first air-fuel ratio correction quantity returns to the predetermined value.

According to this arrangement, the first air-fuel ratio correction quantity calculation means calculates a first air-fuel ratio correction quantity according to a value provided by the first air-fuel ratio sensor, and the second air-fuel ratio correction quantity calculation means calculates a second air-fuel ratio correction quantity according to a value provided by the second air-fuel ratio sensor.

If an average of first air-fuel ratio correction quantities is smaller than the predetermined value, a final air-fuel ratio correction quantity is calculated according to the first and second air-fuel ratio correction quantities.

If a change in the averaged first air-fuel ratio correction quantity exceeds the predetermined value, the second air-fuel ratio correction quantity fixing step or means fixes the second air-fuel ratio correction quantity to a predetermined value for a period of from the start of the excessive change until the predetermined time has elapsed after the change in the averaged quantity returns to the predetermined value. Then, the air-fuel ratio correction quantity calculation step or means calculates a final air-fuel ratio correction quantity according to the first air-fuel ratio correction quantity and the fixed second air-fuel ratio correction quantity.

The final air-fuel ratio correction quantity calculated according to the first and second air-fuel ratio correction quantities controls an actual air-fuel ratio, and as a result, characteristics of the air-fuel ratio feedback control are little affected by exhaust components, and thus will be accurate and stable during a steady operation.

A change in the averaged first air-fuel ratio correction quantity is used to accurately and quickly find a low-degree transient operation. According to the detected transient operation and a response delay of the second air-fuel ratio sensor due to the transient operation, the second air-fuel ratio correction quantity is fixed before calculating a final air-fuel ratio correction quantity. This minimizes a deviation of air-fuel ratio due to the correction based on the second air-fuel ratio correction quantity during the transient operation, and properly carries out the air-fuel ratio feedback control even during the transient operation.

The air-fuel ratio is properly controlled not only during the steady operation but also during the transient operation, so that an emission of pollutants such as CO, HC, and NOx is minimized, and a good transient operation (acceleration or deceleration) is ensured.

The first and second air-fuel ratio sensors may be oxygen sensors that detect an air-fuel ratio in response to an oxygen concentration in an exhaust.

When the oxygen sensors are employed, it is preferable to set the predetermined time used in the second air-fuel ratio correcting quantity fixing step or means to a sum of a delay time during which an exhaust travels from the first air-fuel ratio sensor to the second air-fuel ratio sensor and a response delay time of the second air-fuel ratio sensor relative to the first air-fuel ratio sensor due to the $O_2$ storage capacity of the exhaust purifying catalytic converter.

Since the sum of the delay time caused by the exhaust flow and the response delay time corresponds to a detection delay of the second air-fuel ratio sensor relative to a detection by the first air-fuel ratio sensor during the transient operation, the second air-fuel ratio correction quantity is fixed during the summed delay time to accurately avoid an over-correction of the first air-fuel ratio correction quantity by the second air-fuel ratio correction quantity.

The first air-fuel ratio correction quantity calculation step or means may compare an output value of the first air-fuel ratio sensor with a reference value and calculate a first air-fuel ratio correction quantity through an addition and subtraction using a control constant. The second air-fuel ratio correction quantity calculation step or means may calculate a second air-fuel ratio correction quantity for correcting the control constant used for calculating the first air-fuel ratio correction quantity, by comparing an output value of the second air-fuel ratio sensor with a reference value and by carrying out addition and subtraction operations on the output value. The air-fuel ratio correction quantity calculation step or means may compare the output value of the first air-fuel ratio sensor with the reference value and correct the control constant for the first air-fuel ratio correction quantity through an addition and subtraction according to the second air-fuel ratio correction quantity. In this case, the control constant for the first air-fuel ratio correction quantity corrected according to the second air-fuel ratio correction quantity may be a proportional portion or an integral portion.

When an air-fuel ratio to be corrected according to the first air-fuel ratio correction quantity is shifted toward a rich (lean) side due to a deviation in a value detected by the first air-fuel ratio sensor, the second downstream air-fuel ratio sensor detects the rich (lean) state, and a second air-fuel ratio correction quantity is calculated to correct the proportional portion or the integral portion for calculating the first air-fuel ratio correction quantity to a lean (rich) side, to thereby finally correct the shifted air-fuel ratio.

With respect to the various air-fuel ratio control systems, an air-fuel ratio feedback control step or means carries out a feedback correction, according to the final air-fuel ratio correction quantity calculated by the air-fuel ratio correction quantity calculation step or means, on a basic fuel supply quantity that has been set for a cylinder intake air-quantity according to, for example, an engine operating state.

In this way, the air-fuel ratio feedback correction is carried out based on the basic fuel supply quantity, to minimize a fluctuation of an air-fuel ratio correction quantity, and thus suppress a fluctuation of an air-fuel ratio.

EMBODIMENTS

Figure 1:
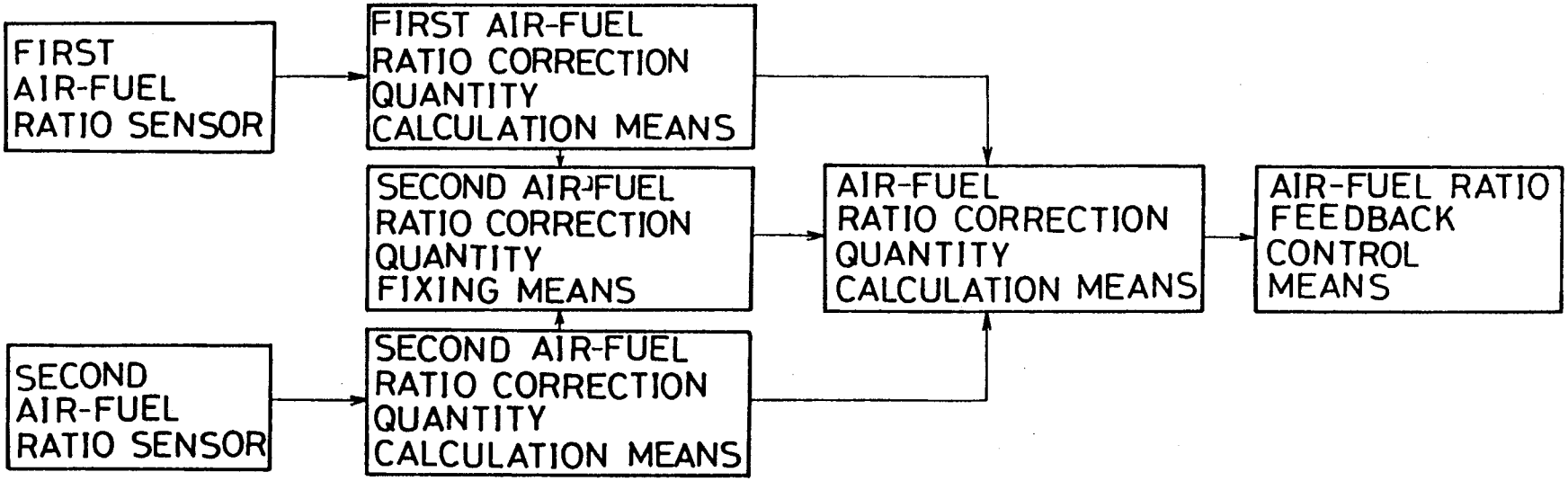
FIG. 1 is a block diagram showing an arrangement of the invention.

An air-fuel ratio control apparatus for an internal combustion engine according to the invention comprises steps or means shown in FIG. 1. The arrangement and operation of an embodiment of the air-fuel ratio control apparatus for the internal combustion engine are shown in FIGS. 2 to 5.

Figure 2:
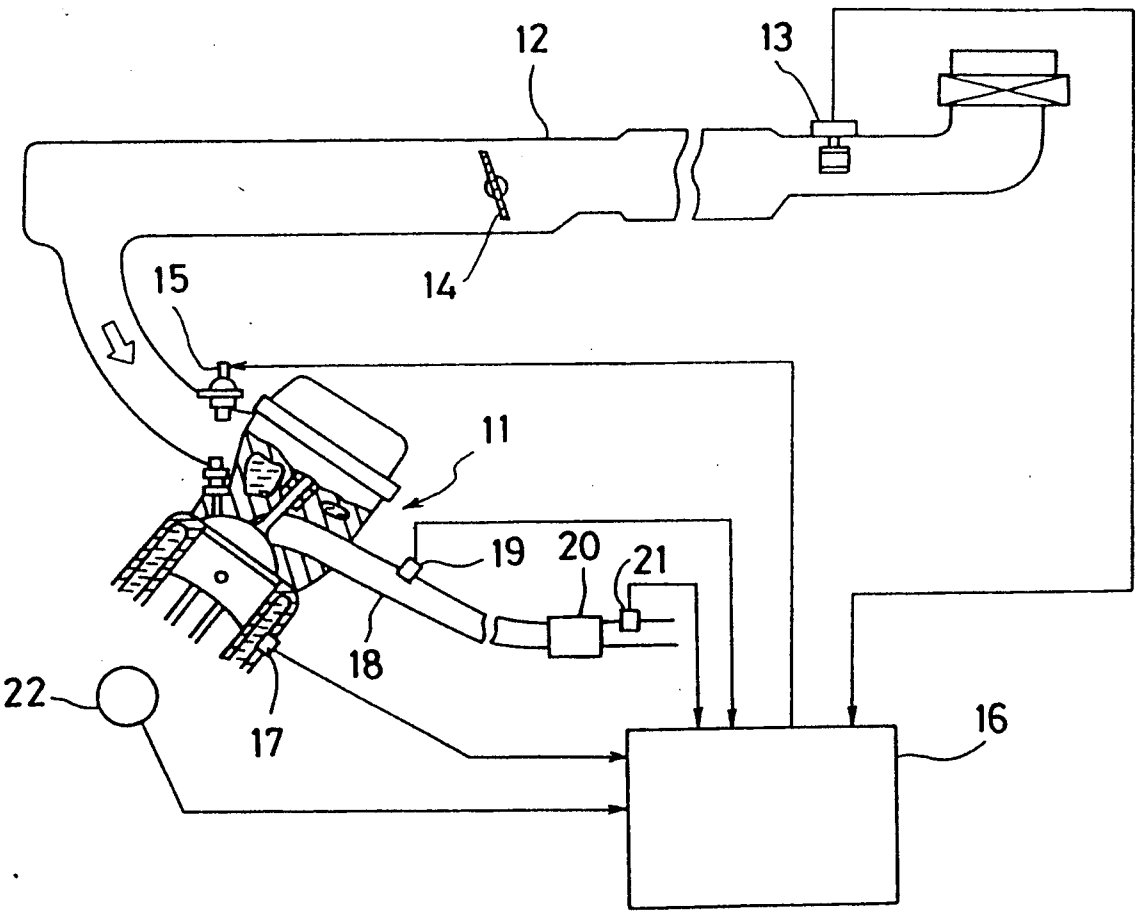
FIG. 2 is a view showing an embodiment of the invention.

In FIG. 2, the engine 11 is connected to an intake path 12, having an airflow meter 13 for detecting an intake air-quantity Q, and throttle valve 14 for controlling the intake air-quantity Q. The throttle valve 14 is interlocked with an acceleration pedal. Each cylinder is provided with a solenoid fuel injection valve 15 at a downstream manifold portion.

The fuel injection valve 15 is driven and opened in response to an injection pulse signal provided by a control unit 16 incorporating a microcomputer. The fuel is pressurized by a fuel pump (not shown), controlled to a predetermined pressure through a pressure regulator, and injected from the fuel injection valve 15. A water temperature sensor 17 detects a temperature Tw of cooling water in a cooling jacket of the engine 11. A first air-fuel ratio sensor 19 is disposed at a manifold collecting portion in an exhaust path 18. The sensor 19 detects an oxygen concentration in an exhaust, thereby detecting the air-fuel ratio of an intake air-fuel mixture. In an exhaust pipe on the downstream side of the sensor 19, there is arranged a three-way catalytic converter 20 serving as an exhaust purifying catalytic converter for oxidizing CO and HC and reducing NOx contained in an exhaust. On the downstream side of the three-way catalytic converter 20, a second air-fuel ratio sensor 21 having the same function as that of the first air-fuel ratio sensor 19 is arranged.

A crank angle sensor 22 is incorporated in a distributor (not shown in FIG. 2). The crank angle sensor 22 provides a unit crank angle signal in synchronism of an engine rotational speed. Unit crank angle signals are counted for a predetermined period, or the period of a reference crank angle signal is measured, to detect an engine rotational speed N.

Figure 3:
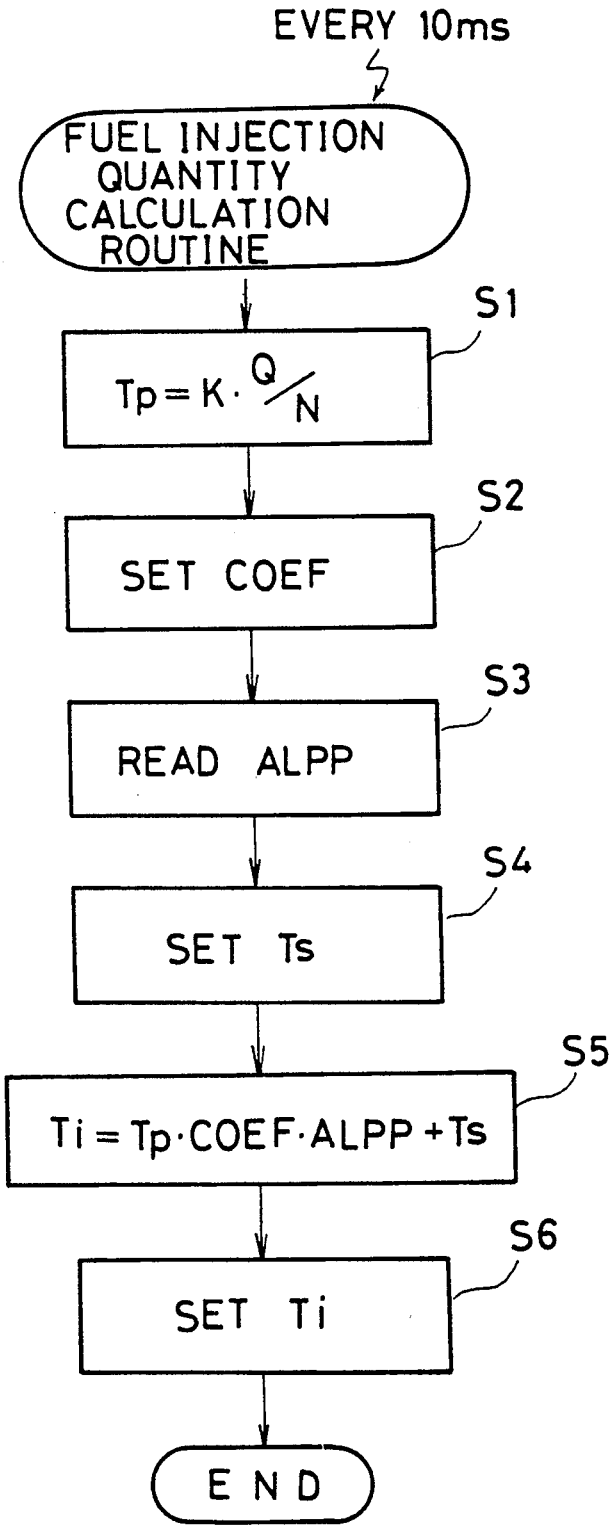
FIG. 3 is a flowchart showing a fuel injection quantity setting routine of the embodiment.

An air-fuel ratio control routine carried out by the control unit 16 will be explained with reference to FIG. 2 and a flowchart of FIG. 3, which shows a fuel injection quantity setting routine to be carried out at predetermined intervals (for example, every 10 ms).

Step (indicated as S in the figures) 1 reads an intake air quantity Q detected by the airflow meter 13 as well as an engine rotational speed N calculated according to signals from the crank angle sensor 22, and calculates a basic fuel injection quantity Tp corresponding to an intake air quantity per revolution according to the following equation:

$$Tp = K \times Q/N \text{(with } K \text{ as a constant)}$$

Step 2 determines a correction coefficient COEF according to a cooling water temperature Tw detected by the water temperature sensor 17.

Step 3 reads an air-fuel ratio feedback correction coefficient ALPP set in the air-fuel ratio feedback correction coefficient setting routine to be explained later.

Step 4 sets a voltage correction portion Ts according to a battery voltage. This is used to correct a change in a fuel injection quantity supplied through the fuel injection valve 15 due to a fluctuation in the battery voltage.

Step 5 calculates a final fuel injection quantity (fuel supply quantity) Ti according to the following equation:

$$Ti = Tp \times COEF \times ALPP + Ts$$

Step 6 sets the calculated fuel injection quantity Ti in an output register.

At a predetermined fuel injection timing in synchronism of the engine rotational speed, a driving pulse signal having a pulse width corresponding to the calculated fuel injection quantity Ti is given to the fuel injection valve 15, which then injects fuel.

In this way, the routine mentioned above sets the fuel supply quantity according to the air-fuel ratio feedback correction coefficient ALPP read in Step 3, to obtain a target air-fuel ratio. This routine forms the air-fuel ratio feedback control step or means.

The air-fuel ratio feedback correction coefficient setting routine will be explained with reference to FIG. 4. This routine is carried out in synchronism with the engine rotation.

Figure 4:
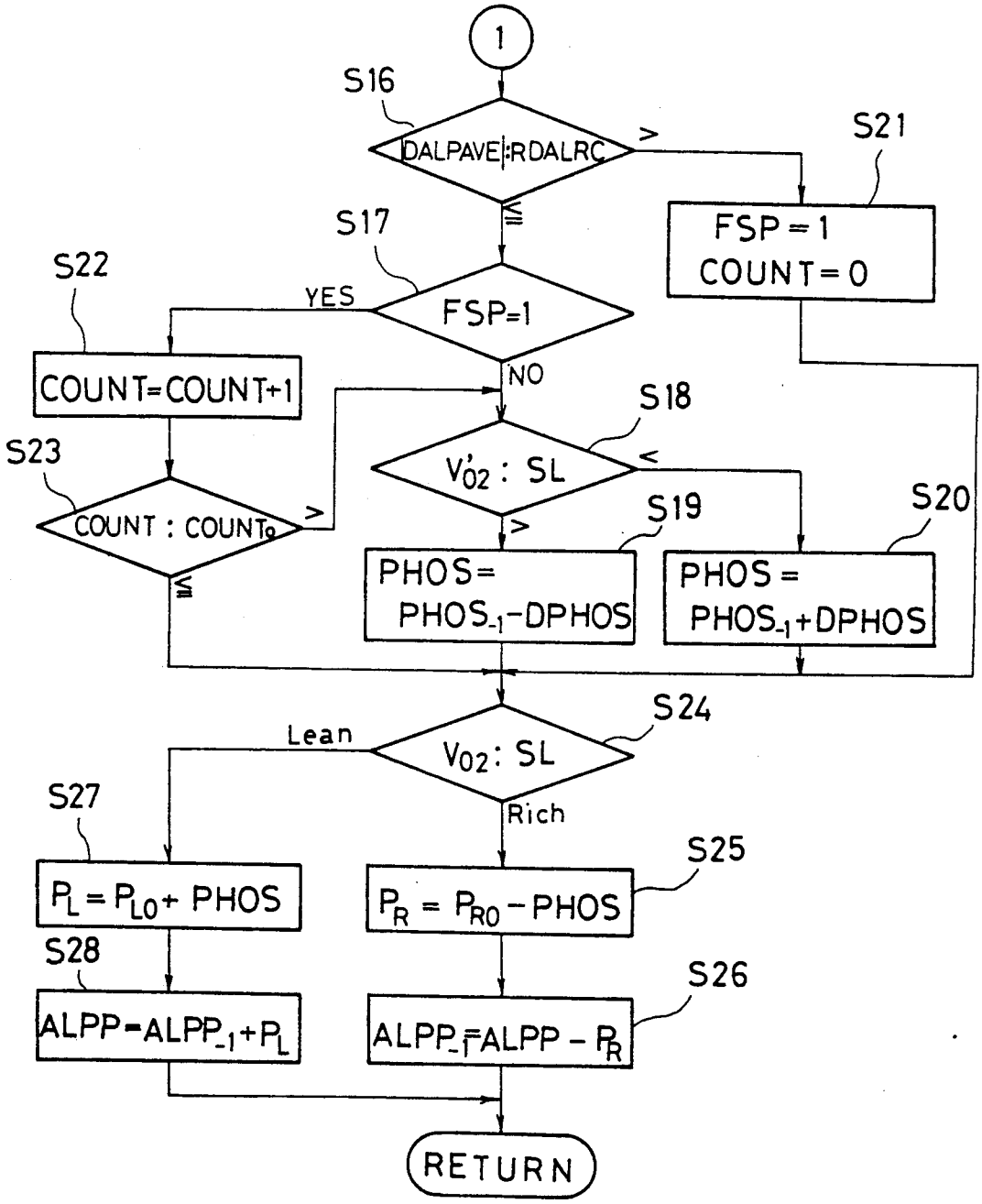
FIG. 4 (4(1) and 4(2)) is a flowchart showing an air-fuel ratio feedback correction coefficient setting routine of the embodiment.
Figure 5:
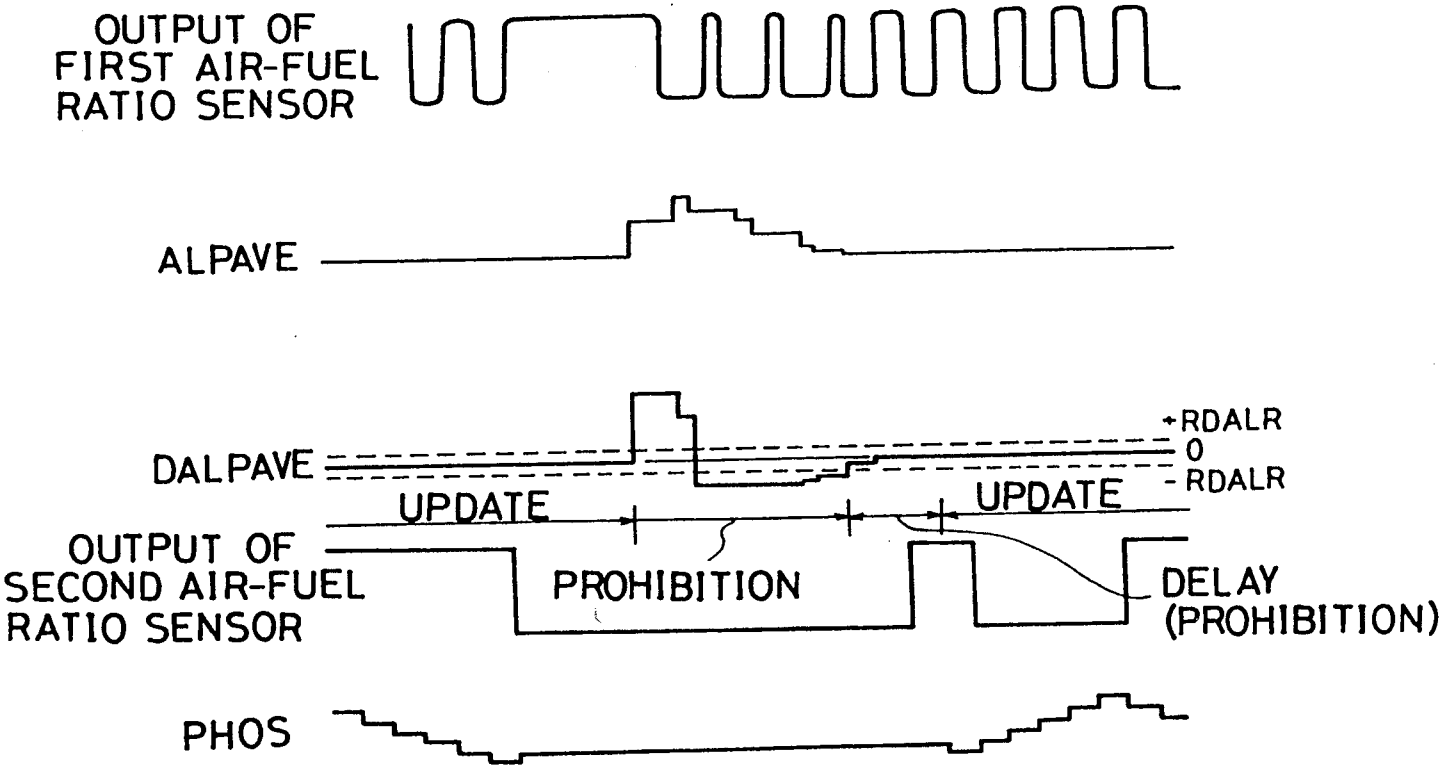
FIG. 5 is a diagram showing states of various parts under an air-fuel ratio feedback control according to the embodiment.

Step 11 in FIG. 4(1) determines whether or not it is an operating condition exists for carrying out the air-fuel ratio feedback control. If not, this routine is terminated, and the air-fuel ratio feedback correction coefficient ALPP is clamped to a value set at the end of the last air-fuel ratio feedback control, or to a predetermined reference value, and thereafter, the air-fuel ratio feedback control is stopped.

Step 12 receives a signal voltage $V_{02}$ from the first air-fuel ratio sensor 19 and a signal voltage $V'_{02}$ from the second air-fuel ratio sensor 21.

Step 13 compares the signal voltage $V_{02}$ obtained in Step 12 with a reference value SL corresponding to a target air-fuel ratio (a theoretical air-fuel ratio), and determines whether or not an air-fuel ratio has been inverted from lean to rich, or from rich to lean.

If an invention is determined, Step 14 averages a present air-fuel ratio feedback correction coefficient $ALPP_0$ and the last $ALPP_{-1}$ for the last air-fuel ratio inversion detected according to the first air-fuel ratio sensor 19, and provides an average $ALPAVE_0(=\{ALPP_0+ALPP_{-1}\}/2)$.

Step 15 calculates a deviation (a change) DALPAVE of the average $ALPAVE_0$ from the last average $ALPAVE_{-1}$.

Step 16 in FIG. 4(2) compares an absolute |DALPAVE| of the deviation calculated in Step 15 with a positive reference value RDALRC for determining a transient operation.

If $|DALPAVE| \leqq RDALRC$, this is not the transient operation, and Step 17 determines whether or not a stop flag FSP is set. The stop flag FSP is used for stopping the setting or updating of a second air-fuel ratio correction quantity (an air-fuel ratio feedback correction coefficient PHOS to be explained later) obtained from the second air-fuel ratio sensor 21.

If the stop flag FSP is not set, Step 18 compares the signal voltage $V'_{02}$ from the second air-fuel ratio sensor 21 with the reference value corresponding to the target air-fuel ratio (the theoretical air-fuel ratio).

If the air-fuel ratio is rich ($V'_{02}>SL$), Step 19 subtracts a predetermined value DPHOS from a proportional correction quantity $PHOS_{-1}$ or a value retrieved from corresponding operation region among operation regions divided according to engine rotational speeds N, basic fuel injection quantities Tp, etc., each region storing a proportional correction quantity as it is or after processing it with a weighted mean learning), and provides a new proportional correction quantity PHOS, and thereafter, Step 24 is carried out.

If the air-fuel ratio is lean ($V'_{02}<SL$), Step 20 adds the predetermined value DPHOS to the proportional correction quantity PHOS-1 and provides a new proportional correction quantity PHOS, and thereafter, Step 24 is carried out.

If Step 16 determines $|DALPAVE|>RDALRC$, Step 21 sets the stop flag FSP to 1, and zeroes a counter COUNT for measuring a delay time for stopping the setting and updating of the second air-fuel ratio correction quantity. Thereafter, Steps 17 to 20 are bypassed, and the proportional correction quantity PHOS is not updated but fixed to the last value (a retrieved value if the learning is carried out).

If the stop flag FSP is set in Step 17, Step 22 increments the counter COUNT, and Step 23 compares the COUNT with a predetermined value $COUNT_0$. If $COUNT \leqq COUNT_0$, the proportional correction quantity PHOS is not updated or learned, and Step 24 is carried out. The predetermined value $COUNT_0$ corresponds to a sum of a delay time during which an exhaust travels from the first air-fuel ratio sensor 19 to the second air-fuel ratio sensor 21 and a response delay time of the second air-fuel ratio sensor 21 relative to the first air-fuel ratio sensor 19 due to the $O_2$ storage capacity of the three-way catalytic converter 20.

As explained before, during the transient operation, the sum of the delay time due to an exhaust flow and the response delay time causes a delay in a detection of the second air-fuel ratio sensor 21 relative to that of the first air-fuel ratio sensor 19. Accordingly, by setting the predetermined value $COUNT_0$ for fixing the second air-fuel ratio correction quantity (PHOS) according to the summed delay, excessive correction of the first air-fuel ratio correction quantity (ALPP) by the second air-fuel ratio correction quantity due to the delay is avoided.

On the other hand, if $COUNT>COUNT_0$, Step 24 starts to update the proportional correction quantity PHOS.

Step 24 determines a rich or lean state according to the first air-fuel ratio sensor 19. If it is determined that a lean state has been inverted to a rich state, Step 25 subtracts the proportional correction quantity PHOS from a reference value PRO, to update a reduction proportional portion PR that is used to set the air-fuel ratio feedback correction coefficient ALPP when a lean state has been inverted to a rich state. Thereafter, Step 26 updates the air-fuel ratio feedback correction coefficient ALPP by subtracting the proportional portion PR from the present coefficient.

When a rich state is inverted to a lean state, Step 27 adds the second air-fuel ratio correction quantity PHOS to a reference value PLO to update an addition proportional portion PL used to set the air-fuel ratio feedback correction coefficient ALPP when a rich state has been inverted to a lean state. Thereafter, Step 28 updates the air-fuel ratio feedback correction coefficient ALPP by adding the proportional portion PL to the present coefficient.

If Step 13 determines that the output of the first air-fuel ratio sensor 19 is not indicating the inversion, Step 29 determines whether the state is rich or lean. If it is rich Step 30 updates the air-fuel ratio feedback correction coefficient ALPP by subtracting an integral portion IR from the present value. If it is lean, Step 31 updates the air-fuel ratio feedback correction coefficient ALPP by adding an integral portion IL to the present value.

Among Step 24 to 31, except for corrections carried out in Steps 25 and 27, the function of setting the air-fuel ratio feedback correction coefficient ALPP forms the first air-fuel ratio correction quantity calculation step or means achieved with the first air-fuel ratio sensor 19 (in which Steps 24 and 29 correspond to a first comparison step or means, and the other steps to the air-fuel ratio feedback correction coefficient calculation step or means). Among Step 18 to 20, the function of setting the proportional correction quantity PHOS forms the second air-fuel ratio correction quantity calculation step or means, in which Step 18 corresponds to a second comparison means, and the other steps to the control constant correction quantity calculation step or means. The functions of Steps 15 to 17 and Steps 21 to 24 and 23 to 24 with Steps 18 to 20 being jumped from the second air-fuel ratio correction quantity fixing step or means (in which Step 23 corresponds to the predetermined time setting step or function). The function of comparing a value based on the first air-fuel ratio sensor 19 with the reference value and correcting the air-fuel ratio feedback correction coefficient ALPP according to the proportional correction quantity PHOS in Steps 24 to 27 from the air-fuel ratio correction quantity calculation step or means (in which Step 24 serves as a third comparison step or means, and Steps 25 and 26 from the control constant correction means).

With this arrangement, even a low-degree transient operation can be precisely detected with a good responsiveness according to the magnitude of a change in an averaged air-fuel ratio feedback correction coefficient. During the detected transient operation and during a response delay time of the second air-fuel ratio sensor 21 due to the transient operation, the proportional correction quantity PHOS is fixed to set the air-fuel ratio feedback correction coefficient ALPP. As a result, a deviation of air-fuel ratio due to correction by the proportional portion during the transient operation can be minimized to maintain a good air-fuel ratio feedback control. Although an averaged air-fuel ratio feedback correction coefficient ALPP is calculated from values including the first and second air-fuel ratio correction quantities, the influence of the proportional correction quantity PHOS, i.e., the second air-fuel ratio correction quantity, can be ignored for the calculation of the average used for determining the transient operation, so that the average may be used as it is, to provide a sufficient accuracy.

This embodiment is based on the air-fuel ratio feedback control carried out according to a value detected by the first air-fuel ratio sensor 19, and a proportional portion of the air-fuel ratio feedback correction coefficient for the feedback control is corrected according to a value detected by the second air-fuel ratio sensor. It is also possible to correct an integral portion of the air-fuel ratio feedback correction coefficient.

It is also possible that the two air-fuel ratio sensors provide a first air-fuel ratio feedback correction coefficient as a first air-fuel ratio correction quantity and a second air-fuel ratio feedback correction coefficient as a second air-fuel ratio correction quantity according to proportional-plus integral control, etc. The two quantities are accumulated and combined to provide an air-fuel ratio feedback correction coefficient.

In this case, when the first air-fuel ratio feedback correction coefficient causes a deviation due to a deviation in a value detected by the first air-fuel ratio sensor, the second air-fuel ratio sensor detects a deviation of air-fuel ratio and provides the second air-fuel ratio feedback correction coefficient to correct the deviation of air-fuel ratio caused by the first air-fuel ratio feedback correction coefficient. Namely, the deviation of air-fuel ratio is corrected by a final air-fuel ratio correction quantity determined by a product of the first and second air-fuel ratio feedback correction coefficients.

The second air-fuel ratio correction quantity may be added to or subtracted from a reference value used for calculating the first air-fuel ratio feedback correction coefficient serving as an air-fuel ratio feedback correction quantity, to thereby calculate a final air-fuel ratio correction quantity.

In this case, if the air-fuel ratio feedback correction coefficient causes a deviation due to a deviation in a value detected by the first air-fuel ratio sensor, the reference value is corrected according to the second air-fuel ratio correction quantity, to finally correct the deviation of air-fuel ratio.

The second air-fuel ratio correction quantity may be added to or subtracted from a delay time starting from when the relationship of sizes between an output value of the first air-fuel ratio sensor and a reference value is inverted until addition and subtraction operations using a control constant are inverted from one to another, to calculate a final air-fuel ratio correction quantity.

In this case, when the air-fuel ratio feedback correction coefficient causes a deviation due to a deviation in a value detected by the first air-fuel ratio sensor, a delay time when inverting the first air-fuel ratio correction quantity after a value detected by the first air-fuel ratio sensor has been inverted is corrected according to the second air-fuel ratio correction quantity, to finally correct the deviation of air-fuel ratio.

As explained above, the invention arranges air-fuel ratio sensors upstream and downstream of an exhaust purifying catalytic converter respectively, and carries out air-fuel ratio feedback control according to values detected by both air-fuel ratio sensors. The invention detects a transient operation according to a change in an averaged first air-fuel ratio correction quantity, thereby precisely detecting even a low-degree transient operation at a good responsiveness. The invention fixes a second air-fuel ratio correction quantity for a response delay time of the second air-fuel ratio sensor caused by the detected transient operation, and calculates a final air-fuel ratio correction quantity. Accordingly, the invention can eliminate a deviation of air-fuel ratio due to the second air-fuel ratio correction quantity during the transient operation, to maintain good air-fuel ratio feedback control. In this way, the invention reduces an emission of pollutants such as CO, HC, and NOx and improves a performance during the transient operation.

CAPABILITY OF EXPLOITATION IN INDUSTRY

As explained above, an air-fuel ratio controlling apparatus for an internal combustion engine according to the invention improves the responsiveness during a transient operation. When the invention is applied for an internal combustion engine of a vehicle, it improves the acceleration and deceleration performances and exhaust purifying capacity of the vehicle, and contributes to an improvement of environmental conditions.

I claim:

1. A method of controlling the air-fuel ratio of an internal combustion engine, including:

a first air-fuel ratio correction quantity calculation step of calculating a first air-fuel ratio correction quantity according to an output value of a first air-fuel ratio sensor disposed upstream of an exhaust purifying catalytic converter in an exhaust path of the engine, the output value of the first air-fuel ratio sensor changing in response to the concentration of a specific gas component contained in an exhaust, the concentration changing according to an air-fuel ratio;

a second air-fuel ratio correction quantity calculation step of calculating a second air-fuel ratio correction quantity according to an output value of a second air-fuel ratio sensor disposed downstream of the exhaust purifying catalytic converter in the exhaust path, the output value of the second air-fuel ratio sensor changing in response to the concentration of the specific gas component contained in the exhaust, the concentration changing according to the air-fuel ratio;

an air-fuel ratio correction quantity calculation step of calculating a final air-fuel ratio correction quantity according to the first and second air-fuel ratio correction quantities; and an air-fuel ratio feedback control step of carrying out feedback control according to the final air-fuel ratio correction quantity, to attain a target air-fuel ratio, the method comprising:

an averaging step of averaging first air-fuel ratio correction quantities; and a second air-fuel ratio correction quantity fixing step of fixing, if a change in the averaged first air-fuel ratio correction quantity exceeds a predetermined value, the second air-fuel ratio correction quantity to a predetermined value so that the air-fuel ratio correction quantity calculation step may calculate the air-fuel ratio correction quantity according to the fixed value, during a period starting from when the change in the averaged first air-fuel ratio correction quantity exceeds the predetermined value until a predetermined time has elapsed after the change returns to below the predetermined value.

2. A method of controlling the air-fuel ratio of an internal combustion engine according to claim 1, wherein the second air-fuel ratio correction quantity fixing step includes a predetermined time setting step of setting the predetermined time to a sum of a delay time during which an exhaust travels from the first air-fuel ratio sensor to the second air-fuel ratio sensor and a response delay time between the first and second air-fuel ratio sensors due to the $O_2$ storage capacity of the exhaust purifying catalytic converter.

3. A method of controlling the air-fuel ratio of an internal combustion engine according to claim 1, wherein the first air-fuel ratio correction quantity calculation step comprises a first comparison step for comparing the output value of the first air-fuel ratio sensor with a predetermined reference value, and an air-fuel ratio feedback correction coefficient calculation step for calculating, according to a result of the comparison carried out in the first comparison step, an air-fuel ratio feedback correction coefficient as the first air-fuel ratio correction quantity through addition or subtraction using a control constant, the second air-fuel ratio calculation step comprises a second comparison step of comparing the output value of the second air-fuel ratio sensor with a reference value, and a control constant correction quantity calculation step of calculating, according to a result of the comparison carried out in the second comparison step, the second air-fuel ratio correction quantity through addition or subtraction, the second air-fuel ratio correction quantity being used for correcting a control constant used for calculating the first air-fuel ratio correction quantity, and the air-fuel ratio correction quantity calculation step comprises a third comparison step of comparing the output value of the first air-fuel ratio sensor with the reference value, and a control constant correcting step of calculating an air-fuel ratio correction quantity by adding or subtracting the second air-fuel correction quantity to or from the control constant for the first air-fuel ratio correction quantity.

4. An apparatus for controlling the air-fuel ratio of an internal combustion engine having:

first and second air-fuel ratio sensors disposed on the upstream and downstream sides, respectively, of an exhaust purifying catalytic converter in an exhaust path of the engine, outputs of the sensors changing in response to the concentration of a specific gas component contained in an exhaust, the concentration changing according to an air-fuel ratio;

a first air-fuel ratio correction quantity calculation means for calculating a first air-fuel ratio correction quantity according to the output value of the first air-fuel ratio sensor;

a second air-fuel ratio correction quantity calculation means for calculating a second air-fuel ratio correction quantity according to the output value of the second air-fuel ratio sensor;

an air-fuel ratio correction quantity calculation means for calculating a final air-fuel ratio correction quantity according to the first and second air-fuel ratio correction quantities;

an air-fuel ratio feedback control means for carrying out feedback control according to the final air-fuel ratio correction quantity to attain a target air-fuel ratio, the apparatus comprising:

an averaging means for averaging first air-fuel ratio correction quantities derived from the first air-fuel ratio sensor; and a second air-fuel ratio correction quantity fixing means for fixing, if a change in the averaged first air-fuel ratio correction quantity exceeds a predetermined value, the second air-fuel ratio correction quantity to a predetermined value so that the air-fuel ratio correction quantity calculation step may calculate the air-fuel ratio correction quantity according to the fixed value, during a period starting from when the change in the averaged first air-fuel ratio correction quantity exceeds the predetermined value until a predetermined time elapses after the change returns below the predetermined value.

5. An apparatus for controlling the air-fuel ratio of an internal combustion engine according to claim 4, wherein each of the first and second air-fuel ratio sensors is an oxygen sensor for detecting an air-fuel ratio in response to an oxygen concentration in an exhaust.

6. An apparatus for controlling the air-fuel ratio of an internal combustion engine according to claim 5, wherein the second air-fuel ratio correction quantity fixing means includes a predetermined time setting means for setting the predetermined time to a sum of a delay time during which an exhaust travels from the first air-fuel ratio sensor to the second air-fuel ratio sensor and a response delay time between the first and second air-fuel ratio sensors due to the $O_2$ storage capacity of the exhaust purifying catalytic converter.

7. An apparatus for controlling the air-fuel ratio of an internal combustion engine according to claim 4, wherein the first air-fuel ratio correction quantity calculation means comprises a first comparison means for comparing the output value of the first air-fuel ratio sensor with a predetermined reference value, and an air-fuel ratio feedback correction coefficient calculation means for calculating an air-fuel ratio feedback correction coefficient as the first air-fuel ratio correction quantity according to a result of the comparison carried out in the first comparison means through addition and subtraction using a control constant, the second air-fuel ratio correction quantity calculation means comprises a second comparison means for comparing the output value of the second air-fuel ratio sensor with a reference value, and a control constant correction quantity calculation means for calculating the second air-fuel ratio correction quantity according to a result of the comparison carried out in the second comparison means through addition and subtraction, the second air-fuel ratio correction quantity being used for correcting the control constant used for calculating the first air-fuel ratio correction quantity, and the air-fuel ratio correction quantity calculation means comprises a third comparison means for comparing the output value of the first air-fuel ratio sensor with the reference value, and a control constant correcting means for calculating an air-fuel ratio correction quantity by adding or subtracting the second air-fuel ratio correction quantity to or from the control constant for the first air-fuel ratio correction quantity.

8. An apparatus for controlling the air-fuel ratio of an internal combustion engine according to claim 7, wherein the control constant for the first air-fuel ratio correction quantity corrected according to the second air-fuel ratio correction quantity is a proportional constant.

9. An apparatus for controlling the air-fuel ratio of an internal combustion engine according to claim 7, wherein the control constant for the first air-fuel ratio correction quantity corrected according to the second air-fuel ratio correction quantity is an integral constant.

10. An apparatus for controlling the air-fuel ratio of an internal combustion engine according to claim 4, wherein the air-fuel ratio feedback control means controls the air-fuel ratio by carrying out feedback control on a basic fuel supply quantity, which is set from an engine operating condition and for a cylinder intake air-quantity, according to the final air-fuel ratio correction quantity calculated by the air-fuel ratio correction quantity calculation means.

* * * * *